US012779292B2

(12) United States Patent
Timms et al.

(10) Patent No.: US 12,779,292 B2
(45) Date of Patent: Nov. 3, 2026

(54) GOLF CLUB ADAPTER

(71) Applicant: Worldwide Golf Cool Clubs LLC, Bethesda, MD (US)

(72) Inventors: Mark Timms, Scottsdale, AZ (US); Glen Pangestu, Mesa, AZ (US)

(73) Assignee: Worldwide Golf Cool Clubs LLC, Bethesda, MD (US)

( * ) Notice: Subject to any disclaimer, the term of this patent is extended or adjusted under 35 U.S.C. 154(b) by 0 days.

(21) Appl. No.: 19/386,499

(22) Filed: Nov. 12, 2025

(65) Prior Publication Data

US 2026/0131207 A1 May 14, 2026

Related U.S. Application Data

(60) Provisional application No. 63/719,279, filed on Nov. 12, 2024.

(51) Int. Cl.
*A63B 53/02* (2015.01)

(52) U.S. Cl.
CPC ..... *A63B 53/023* (2020.08)

(58) Field of Classification Search
CPC ..... A63B 53/02; A63B 53/023–028
See application file for complete search history.

(56) References Cited

U.S. PATENT DOCUMENTS

| | | | | |
|---|---|---|---|---|
| 5,951,411 | A | 9/1999 | Wood et al. | |
| 6,890,269 | B2 | 5/2005 | Burrows | |
| 7,997,997 | B2 * | 8/2011 | Bennett | A63B 53/02 473/307 |
| 8,795,099 | B2 * | 8/2014 | Sato | A63B 53/02 473/246 |
| 2004/0018886 | A1 | 1/2004 | Burrows | |
| 2004/0018887 | A1 | 1/2004 | Burrows | |
| 2007/0173344 | A1 * | 7/2007 | Burch | A63B 53/02 473/307 |

FOREIGN PATENT DOCUMENTS

| | | | |
|---|---|---|---|
| GB | 325677 | A | 2/1930 |
| WO | 2004009186 | A1 | 1/2004 |

OTHER PUBLICATIONS

"TaylorMade Golf—All-new SelectFit Kit, a revolutionary Custom Fitting Technology." (Dec. 12, 2022). My Golf Way. https://www.mygolfway.com/en/taylormade-golf-all-new-selectfit-kit-revolutionary-custom-fitting-technology/.

* cited by examiner

*Primary Examiner* — Brian O Peters
(74) *Attorney, Agent, or Firm* — FINNEGAN, HENDERSON, FARABOW, GARRETT & DUNNER LLP

(57) ABSTRACT

The present disclosure relates generally to a golf club adapter configured to couple a golf club shaft with a golf club head. In one embodiment, a golf club adapter is disclosed, comprising a body insert configured to be inserted into a hosel of a golf club head and a head portion configured to engage an outer surface of the hosel of the golf club head and substantially prevent rotation between of the golf club shaft and the golf club head. The body insert includes a longitudinal axis, a shaft bore configured to receive a golf club shaft, wherein the shaft bore is angled relative to the longitudinal axis of the body insert, and an engagement aperture configured to receive a fastener.

20 Claims, 12 Drawing Sheets

GOLF CLUB ADAPTER

CROSS-REFERENCE RELATED APPLICATIONS

This disclosure claims priority to U.S. Provisional Application No. 63/719,279, titled "GOLF CLUB ADAPTER," filed Nov. 12, 2024. The entire contents of the aforementioned application are incorporated by reference herein for all purposes.

FIELD OF THE DISCLOSURE

Embodiments of this disclosure generally relate to improvements in golf clubs, and particularly adapters for interchangeably connecting golf club heads and golf club shafts.

BACKGROUND

To suit an individual golfer's desired golf club characteristics and performance, a golf club can be assembled from many different types and brands of golf club heads and shafts. Many golf club adapters that connect a golf club head to a golf club shaft, however, only function or fit for a specific subset of shafts and heads. Therefore, it would be desirable to have an improved golf club adapter that allows a multitude or all shafts to be connected to a multitude or all heads and can be used to assemble a golf club from any combination of golf club heads and shafts.

Furthermore, some existing golf club adapters comprise multiple pieces, any of which can be misplaced or lost and are otherwise not interchangeable with other existing adapter components, rendering the golf club adapter as a whole unusable. Additionally, existing multi-piece golf club adapters typically comprise one piece attached to the head, one piece attached to the shaft, a means for resisting relative twisting between the head and the shaft, and a means for drawing the head and the shaft together. Further, many multi-piece golf club adapters require specialized linkages and tools to tighten or loosen said linkages. Therefore, it would also be highly desirable to have an improved golf club adapter that comprises a single piece, which may, among other things, ease assembly of the various golf club head and shaft combinations and reduce weight.

SUMMARY OF THE DISCLOSURE

Embodiments of the present disclosure are directed to an improved and versatile golf club adapter.

Certain embodiments of the present disclosure may include a golf club adapter, comprising a body insert configured to be inserted into a hosel of a golf club head and a head portion configured to engage an outer surface of the hosel of the golf club head and substantially prevent rotation between of the golf club shaft and the golf club head. The body insert may include a longitudinal axis, a shaft bore configured to receive a golf club shaft, wherein the shaft bore is angled relative to the longitudinal axis of the body insert, and an engagement aperture configured to receive a fastener.

Certain embodiments of the present disclosure may also include a golf club adapter, comprising a body insert configured to be inserted into a hosel of a golf club head, a weight sleeve configured to releasably engage with the body insert, and a head portion configured to engage an outer surface of the hosel of the golf club head and substantially prevent rotation between of the golf club shaft and the golf club head. The body insert may include a top segment having a first outer diameter, a bottom segment having a second outer diameter less than the first outer diameter, a middle segment positioned between the top segment and the bottom segment, a shaft bore configured to receive a golf club shaft, wherein the shaft bore extends at least partially through the top segment, and an engagement aperture configured to receive a fastener, wherein the engagement aperture extends at least partially through the bottom segment.

Certain embodiments of the present disclosure may further include a golf club, comprising a golf club head including a hosel, a golf club shaft, and a golf club adapter configured to releasably connect the golf club shaft to the golf club head. The golf club adapter may include a body insert configured to be inserted into the hosel of the golf club head, a weight sleeve configured to releasably engage with the body insert, and a head portion configured to engage an outer surface of the hosel of the golf club head and substantially prevent rotation between of the golf club shaft and the golf club head. The body insert may include a top segment having a first outer diameter, a bottom segment having a second outer diameter less than the first outer diameter, a middle segment positioned between the top segment and the bottom segment, a shaft bore configured to receive the golf club shaft, wherein the shaft bore extends at least partially through the top segment, and an engagement aperture configured to receive a fastener, wherein the engagement aperture extends at least partially through the bottom segment.

Additional objects and advantages of the embodiments will be set forth in part in the description which follows, and in part will be obvious from the description, or may be learned by practice. The objects and advantages will be realized and attained by means of the elements and combinations particularly pointed out in the appended claims.

It is to be understood that both the foregoing general description and the following detailed description are exemplary and explanatory only and are not restrictive of the claims.

BRIEF DESCRIPTION OF THE DRAWINGS

The accompanying drawings, which are incorporated in and constitute a part of this specification, illustrate several embodiments and together with the description, serve to explain some principles.

Figure 1A:
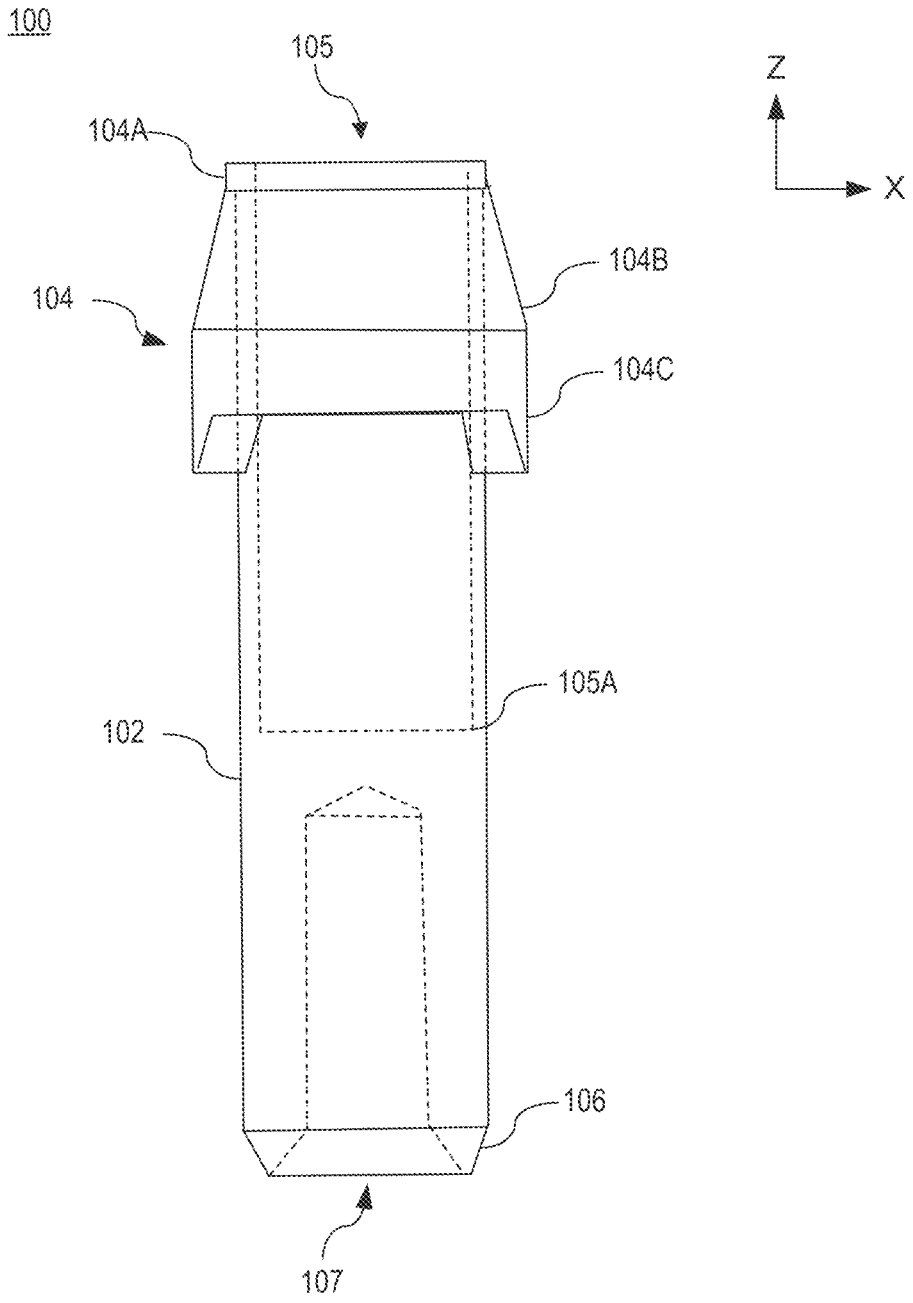
FIG. 1A illustrates a side view of an exemplary golf club adapter with certain parts shown in transparency, consistent with disclosed embodiments.
Figure 1B:
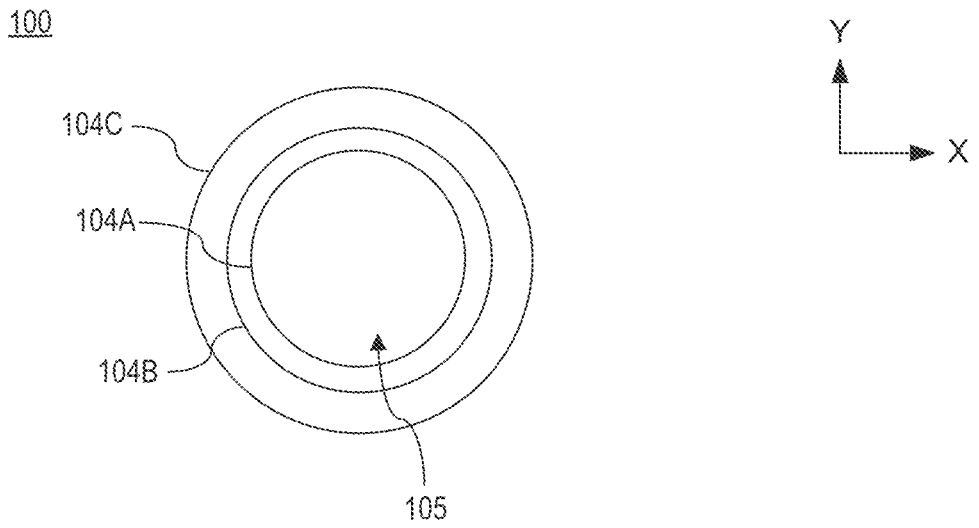
FIG. 1B illustrates a top view of the exemplary golf club adapter depicted in FIG. 1A, consistent with disclosed embodiments.
Figure 1C:
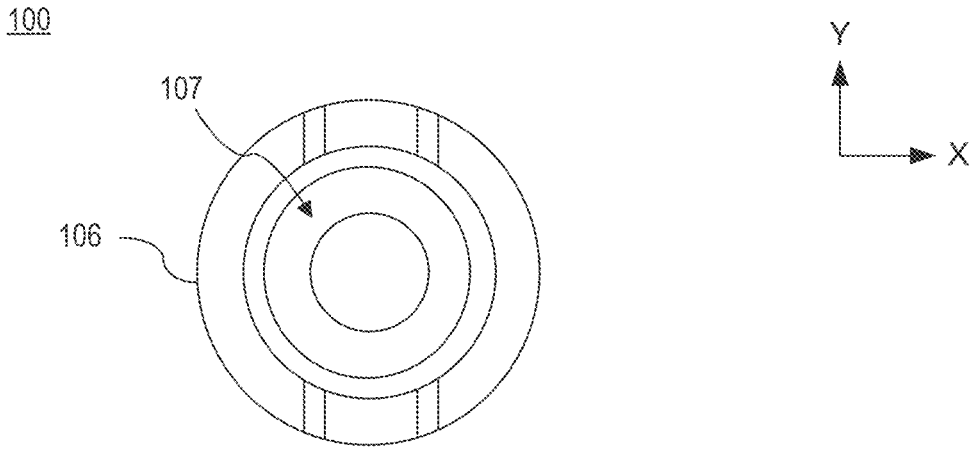
FIG. 1C illustrates a bottom view of the exemplary golf club adapter depicted in FIG. 1A, consistent with disclosed embodiments.

For purposes of description and illustration only, certain figures include reference axes (e.g., X, Y, and Z) that may indicate relative directions or orientations of the depicted components. These axes are provided solely to assist in understanding the spatial relationships shown in the drawings. The use of such axes, or any terms such as "upper," "lower," "front," "rear," "left," "right," "longitudinal," "transverse," or similar terms, is for convenience of description only and does not imply any fixed or required orientation of the components in use or operation unless otherwise explicitly stated. Different figures may show the same component from different perspectives or rotations about one or more of the axes, and such variations are not intended to limit the scope of the disclosure.

DETAILED DESCRIPTION

Reference will now be made in detail to exemplary embodiments, examples of which are illustrated in the accompanying drawings. The following description refers to the accompanying drawings in which the same or similar numbers (e.g., 101 and 201) in different drawings represent the same or similar elements unless otherwise represented. The implementations set forth in the following description of exemplary embodiments do not represent all implementations consistent with the disclosure. Instead, they are merely examples of apparatuses and methods consistent with aspects related to the subject matter recited in the appended claims.

Some golf clubs may include modular or swappable golf club heads and/or golf club shafts. In order to facilitate a secure connection between these modular components, a golf club adapter is disclosed herein. For example, to assemble a golf club, any suitable golf club shaft may be secured within a shaft bore of a golf club adapter. The golf club adapter may then be inserted into a hosel of any suitable golf club head. The golf club head may be secured to the golf club adapter. For example, a fastener, such as a screw, may be inserted through a connecting hole or bore on a bottom or sole portion of the golf club head. The connecting hole may be generally located near the heel portion of the golf club head and may be axially aligned and in communication with an engagement aperture of a golf club adapter. The fastener may be inserted through the connecting hole of the golf club head and the engagement aperture of the golf club adapter to secure the golf club head to the golf club adapter and the golf club shaft. The fastener may also be readily disengaged to disconnect the golf club shaft from the golf club head. In this manner, any combination of golf club heads and golf club shafts may be readily assembled to fit any particular performance properties desired by the user.

FIGS. 1A-1E illustrate various views of an exemplary golf club adapter 100, consistent with disclosed embodiments. In some embodiments, golf club adapter 100 may include a body insert 102, a head 104, and a base 106. In FIG. 1A, body insert 102, head 104, and base 106 are depicted as transparent to show that body insert 102 may include a shaft bore 105 and an engagement aperture 107. Shaft bore 105 may extend from a top end of golf club adapter 100 (e.g., head 104) and partially through body insert 102. Engagement aperture 107 may extend from base 106 and partially through body insert 102. Although body insert 102, head 104, and base 106 are labeled and described as separate components for descriptive purposes, it should be understood that any combination of body insert 102, head 104, and base 106 may be a single piece or component.

In some embodiments, body insert 102 may include a longitudinal axis and a transverse axis. For example, the longitudinal axis may refer to an axis extending along the principal length of body insert 102 (e.g., in direction Z). Further, the transverse axis may refer to an axis extending generally perpendicular or orthogonal to the longitudinal axis of body insert 102 (e.g., in direction X or direction Y).

In some embodiments, shaft bore 105 may be configured to receive a tip end of a golf club shaft. For example, a golf club shaft may be inserted into shaft bore 105 and engage a bottom portion 105A of shaft bore 105. In some embodiments, a golf club shaft may be fixedly secured to shaft bore 105. For example, once shaft bore 105 receives a golf club shaft, the golf club shaft may be fastened thereto and may be prevented from rotating or sliding out of shaft bore 105. By way of a non-limiting example, an adhesive or epoxy may be applied to the surfaces of shaft bore 105 and/or the tip end of a golf club shaft to securely bond the golf club shaft to shaft bore 105. Additionally, or alternatively, shaft bore 105 and/or the tip end of a golf club shaft may be appropriately dimensioned to secure the golf club shaft to the golf club adapter 100 via a friction fit arrangement. For example, shaft bore 105 may have a diameter slightly smaller than the tip end of a golf club shaft (or vice versa) such that, once shaft bore 105 receives the tip end of the golf club shaft, the friction between the walls and bottom portion 105A of shaft bore 105 and the tip end of the golf club shaft may form a tight interface and prevent the golf club shaft from rotating or moving relative to golf club adapter 100.

In some embodiments, a golf club shaft may be releasably secured to shaft bore 105. For example, once shaft bore 105 receives a golf club shaft, the golf club shaft may be fastened thereto and may resist rotational torques and/or pulling forces up to a threshold. By way of a non-limiting example, when using a friction fit arrangement, shaft bore 105 (e.g., walls or bottom portion 105A of shaft bore 105) may include a static friction value selected so that the golf club shaft may not rotate or slide out of shaft bore 105 during normal operation (e.g., while swinging a golf club) but may rotate or slide out of shaft bore 105 during a replacement or swap operation (e.g., replacing the golf club shaft with another golf club shaft). Additionally, or alternatively, in some embodiments, the golf club adapter 100 may employ a releasable fastener, such as a cap, pin, cams, or the like, to releasably secure the golf club shaft in shaft bore 105.

In some embodiments, golf club adapter 100 may facilitate adjustability of the angle(s) of engagement between the golf club head and the golf club shaft. For example, golf club adapter 100 may further comprise a sleeve configured to be received by shaft bore 105. The sleeve may include a bore or channel having a desired angled arrangement and may be configured to receive and secure a tip end of a golf club shaft. The sleeve may be releasably secured to shaft bore 105 via any suitable means, such as, for example, a threaded arrangement, pins, or removable fasteners. In such a manner, various golf club shafts and sleeves with any angled arrangement may be readily engaged and disengaged with body insert 102 to customize the desired combination of golf club shaft, golf club head, and performance specifications, such as, for example, loft angles and/or lie angles. In other embodiments, the sleeve may include a bore or channel having a substantially parallel arrangement relative to a longitudinal axis of the sleeve (e.g., along a principal length of the sleeve). The sleeve may also have a diameter that is smaller than a diameter of shaft bore 105 such that the sleeve may tilt inside shaft bore 105 to achieve the desired angled arrangement between the golf club shaft and the golf club head. The sleeve may be releasably secured to shaft bore 105 via any suitable means, such as, for example, a threaded arrangement, pins, or removable fasteners. In some embodiments, the sleeve may be releasably coupled to shaft bore 105 via an interface on an outer surface of golf club adapter 100. For example, the interface may be coupled to the sleeve via a cam, eccentric pin, or threaded adjuster such that interacting with the interface may alter the angle between the longitudinal axis of the sleeve relative to shaft bore 105. In some embodiments, the interface may include a lever, a dial, a switch, or a button.

In some embodiments, shaft bore 105 may be substantially parallel to a longitudinal axis of golf club adapter 100. For example, the longitudinal axis of shaft bore 105 (e.g., in direction Z) may be substantially colinear with the longitudinal axis of body insert 102. In some embodiments, shaft bore 105 may be oriented at an angle relative to the longitudinal axis of body insert 102. For example, the longitudinal axis of shaft bore 105 may have a non-parallel arrangement relative to the longitudinal axis of body insert 102 to facilitate, for example, a desired lie angle. By way of a non-limiting example, the longitudinal axis of shaft bore 105 may be offset relative to the longitudinal axis of body insert 102 by one to two degrees. Shaft bore 105 may also be oriented at an angle relative to a transverse axis of body insert 102 (e.g., into or out of the plane of FIG. 1A relative to directional axis Y) to facilitate, for example, a desired loft angle. In some embodiments, shaft bore 105 may be oriented in a non-perpendicular arrangement relative to the transverse axis of body insert 102. It should be appreciated that shaft bore 105 may be oriented at any suitable angle(s) relative to body insert 102 to accommodate desired performance specifications of the golf club, such as, for example, various loft angles and/or lie angles.

Figure 5A:
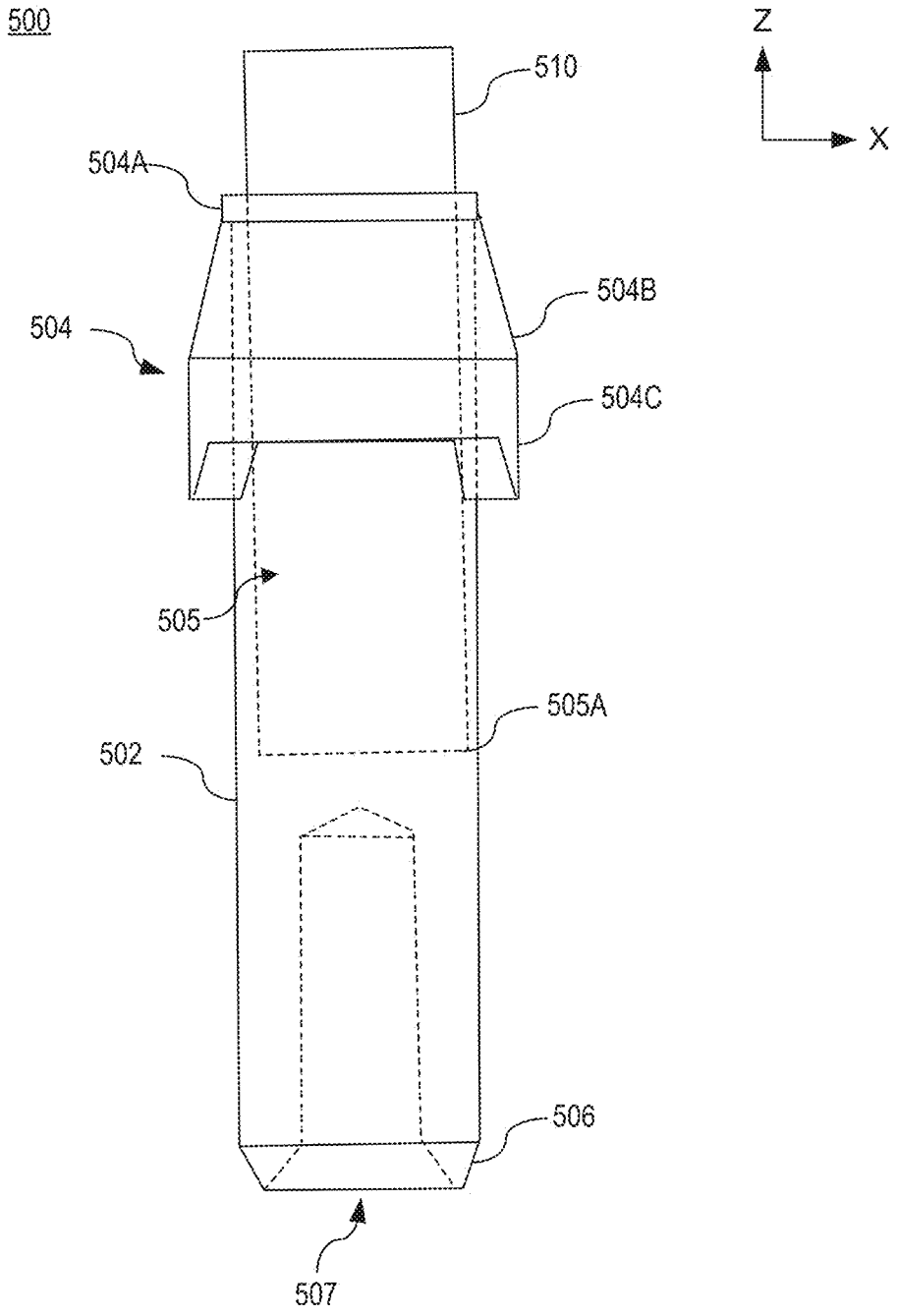
FIG. 5A illustrates a side view of an exemplary golf club adapter with certain parts shown in transparency, consistent with disclosed embodiments.

In such embodiments wherein the longitudinal axis of shaft bore 105 is not colinear with or non-parallel relative to the longitudinal axis of body insert 102, rotating a golf club shaft affixed to golf club adapter 100 may change the loft angle and/or lie angle of the golf club. For example, FIG. 5A illustrates a side view of an exemplary golf club adapter 500 with certain parts shown in transparency, consistent with disclosed embodiments. Golf club adapter 500 may be understood to be similar to golf club adapter 100 except as explicitly described below. For example, golf club adapter 500 may include a body insert 502, a shaft bore 505 into which a golf club shaft 510 may be inserted, a head 504 comprising a top portion 504A, a middle portion 504B, and a bottom portion 504C, a base 506, and an engagement aperture 507. As depicted in FIG. 5A, a longitudinal axis of shaft bore 505 is angled relative to a longitudinal axis of body insert 502. By way of a non-limiting example, the longitudinal axis of shaft bore 505 may be angled by one to two degrees relative to the longitudinal axis of body insert 502. In this way, by rotating golf club shaft 510 secured within shaft bore 505, the loft angle and/or the lie angle may be adjusted.

Figure 5B:
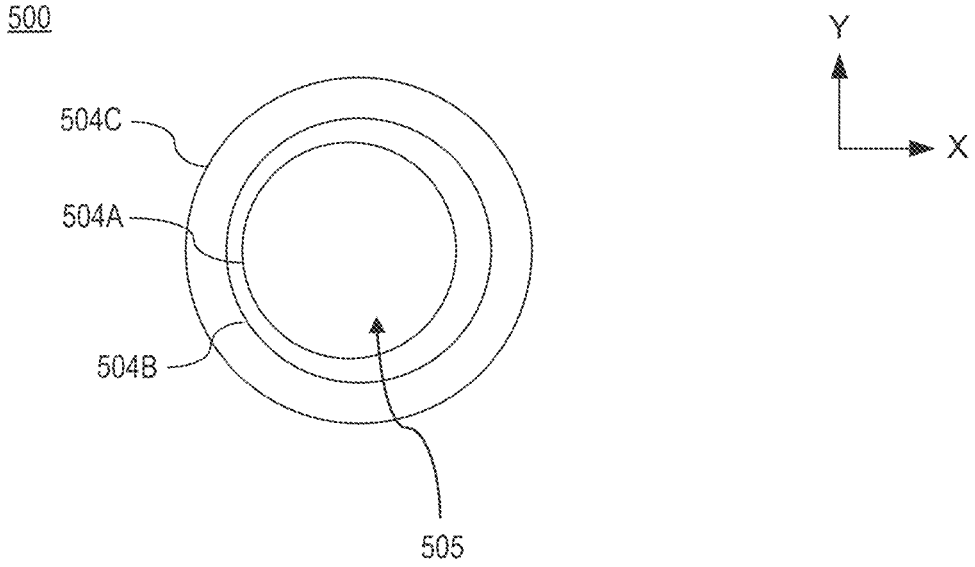
FIG. 5B illustrates a top view of the exemplary golf club adapter depicted in FIG. 5A in a first configuration, consistent with disclosed embodiments.
Figure 5C:
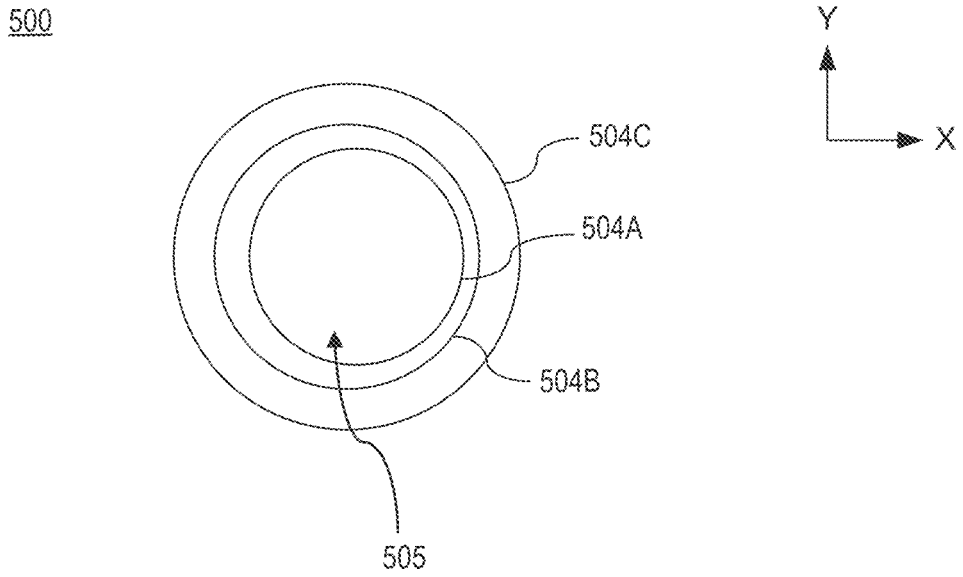
FIG. 5C illustrates a top view of the exemplary golf club adapter depicted in FIG. 5A in a second configuration, consistent with disclosed embodiments.
Figure 5D:
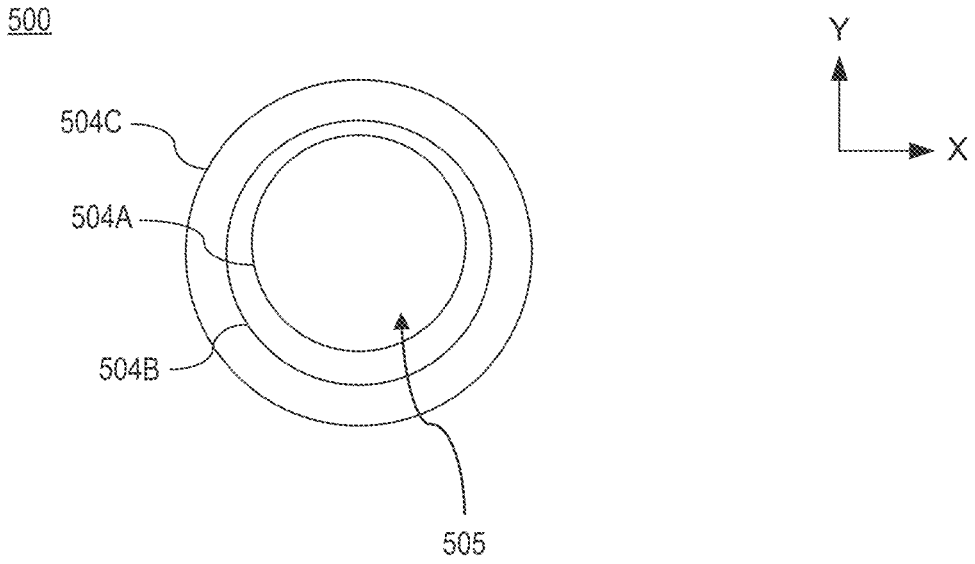
FIG. 5D illustrates a top view of the exemplary golf club adapter depicted in FIG. 5A in a third configuration, consistent with disclosed embodiments.
Figure 5E:
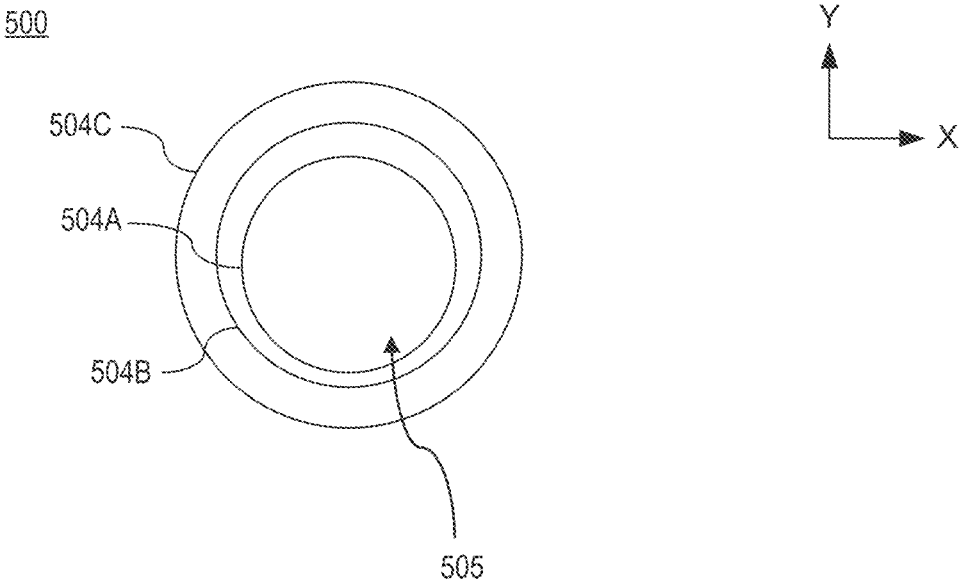
FIG. 5E illustrates a top view of the exemplary golf club adapter depicted in FIG. 5A in a fourth configuration, consistent with disclosed embodiments.

For example, FIG. 5B illustrates a top view of golf club adapter 500 in a first configuration, consistent with disclosed embodiments. As depicted in FIG. 5B, golf club shaft 510 is positioned within shaft bore 505 at an angle to increase the loft angle (i.e., golf club shaft 510 may be angled away from a club face). Further, FIG. 5C illustrates a top view of golf club adapter 500 in a second configuration, consistent with disclosed embodiments. As depicted in FIG. 5C, golf club shaft 510 and golf club adapter 500 may be rotated to a second position (e.g., rotated 180 degrees relative to the first configuration of FIG. 5B) to decrease the loft angle (i.e., golf club shaft 510 may be angled towards a club face). Additionally, FIG. 5D illustrates a top view of golf club adapter 500 in a third configuration, consistent with disclosed embodiments. As depicted in FIG. 5D, golf club shaft 510 and golf club adapter 500 may be rotated to a third position (e.g., rotated 90 degrees in the clockwise direction relative to the first configuration of FIG. 5B) to adjust the lie angle to a more upright lie angle. Moreover, FIG. 5E illustrates a top view of golf club adapter 500 in a fourth configuration, consistent with disclosed embodiments. As depicted in FIG. 5E, golf club shaft 510 and golf club adapter 500 may be rotated to a fourth position (e.g., rotated 90 degrees in the counterclockwise direction relative to the first configuration of FIG. 5B) to adjust the lie angle to a flatter lie angle. Additionally, or alternatively, in some embodiments, a longitudinal axis of engagement aperture 507 may similarly be angled. For example, the orientation of a fastener securing a golf club head to golf club adapter 500 may adjust a loft angle and/or a lie angle.

In some embodiments, the body insert of the golf club adapter of the present disclosure may be configured to be inserted into a hosel of a golf club head. For example, and with reference to FIG. 1A, body insert 102 may be inserted into a hosel of a golf club head. The hosel of the golf club head may include a bore configured to receive body insert 102. As discussed, in some embodiments, base 106 may include engagement aperture 107. For example, engagement aperture may include a hole or bore. In some embodiments, engagement aperture 107 may be configured to receive a releasable fastener. For example, a fastener may include a screw, a bolt, a pin, an anchor, or any other suitable releasable fastener. In this way, body insert 102 may be inserted into a hosel of a golf club head and then may be releasably secured to the golf club head via the fastener inserted through a connecting hole or bore on a bottom or sole portion of the golf club head and into engagement aperture 107, thereby preventing the golf club head from substantially rotating or moving relative to golf club adapter 100 and the golf club shaft connected thereto.

In some embodiments, an angle of engagement aperture 107 may be adjustable. For example, engagement aperture 107 may include a sleeve configured to receive a fastener. The sleeve may also have a diameter that is smaller than a diameter of engagement aperture 107 such that the sleeve may tilt inside engagement aperture 107 to achieve the desired angled arrangement between the golf club shaft and the golf club head. The sleeve may be secured to engagement aperture 107 via any suitable means, such as, for example, a threaded arrangement, pins, or removable fasteners. In some embodiments, the sleeve may be coupled to an interface on an outer surface of golf club adapter 100. For example, the interface may be coupled to the sleeve via a cam, eccentric pin, or threaded adjuster such that interacting with the interface changes the axis of the sleeve relative to engagement aperture 107. In some embodiments, the interface may include a lever, a dial, a switch, or a button.

In some embodiments, engagement aperture 107 may be substantially parallel to a longitudinal axis of golf club adapter 100 (e.g., in direction Z). The longitudinal axis of engagement aperture 107 may refer to an axis extending along a principal length of engagement aperture 107 (e.g., in direction Z). For example, the longitudinal axis of engagement aperture 107 may be substantially colinear with the longitudinal axis of body insert 102. In some embodiments, engagement aperture 107 may be oriented at an angle relative to the longitudinal axis of body insert 102. For example, the longitudinal axis of engagement aperture 107 may have a non-parallel arrangement relative to the longitudinal axis of body insert 102 to facilitate, for example, a desired lie angle. By way of a non-limiting example, the angle may include one degree of offset to two degrees of offset. Engagement aperture 107 may also be oriented at an angle relative to a transverse axis of body insert 102 (i.e., into or out of the plane of FIG. 1A relative to direction Y) to facilitate, for example, a desired loft angle. In some embodiments, engagement aperture 107 may be oriented in a non-perpendicular arrangement relative to the transverse axis of body insert 102. It should be appreciated that engagement aperture 107 may be oriented at any suitable angle(s) relative to the body insert 102 to accommodate desired performance specifications of the golf club, such as, for example, various loft angles and/or lie angles. In such embodiments wherein the longitudinal axis of engagement aperture 107 is not colinear with or non-parallel relative to the longitudinal axis of body insert 102, rotating a shaft of a golf club affixed to golf club adapter 100 may change the loft angle and/or lie angle.

In some embodiments, shaft bore 105 and engagement aperture 107 may not be connected. For example, shaft bore 105 and engagement aperture 107 may be two separate cavities in body insert 102. In some embodiments, shaft bore 105 and engagement aperture 107 may be connected. For example, shaft bore 105 and engagement aperture 107 may form a continuous cavity through body insert 102.

Figure 1E:
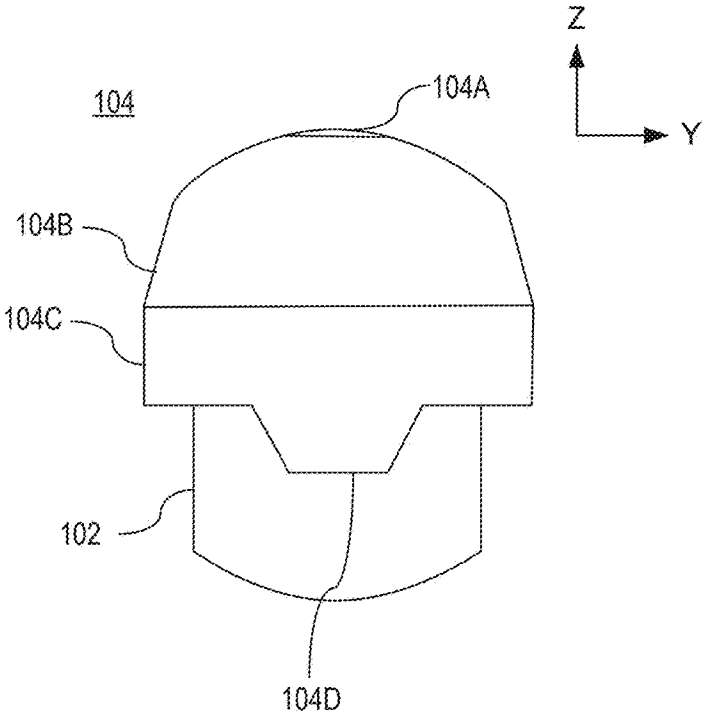
FIG. 1E illustrates a close-up view of a head of the exemplary golf club adapter depicted in FIG. 1D, consistent with disclosed embodiments.
Figure 1D:
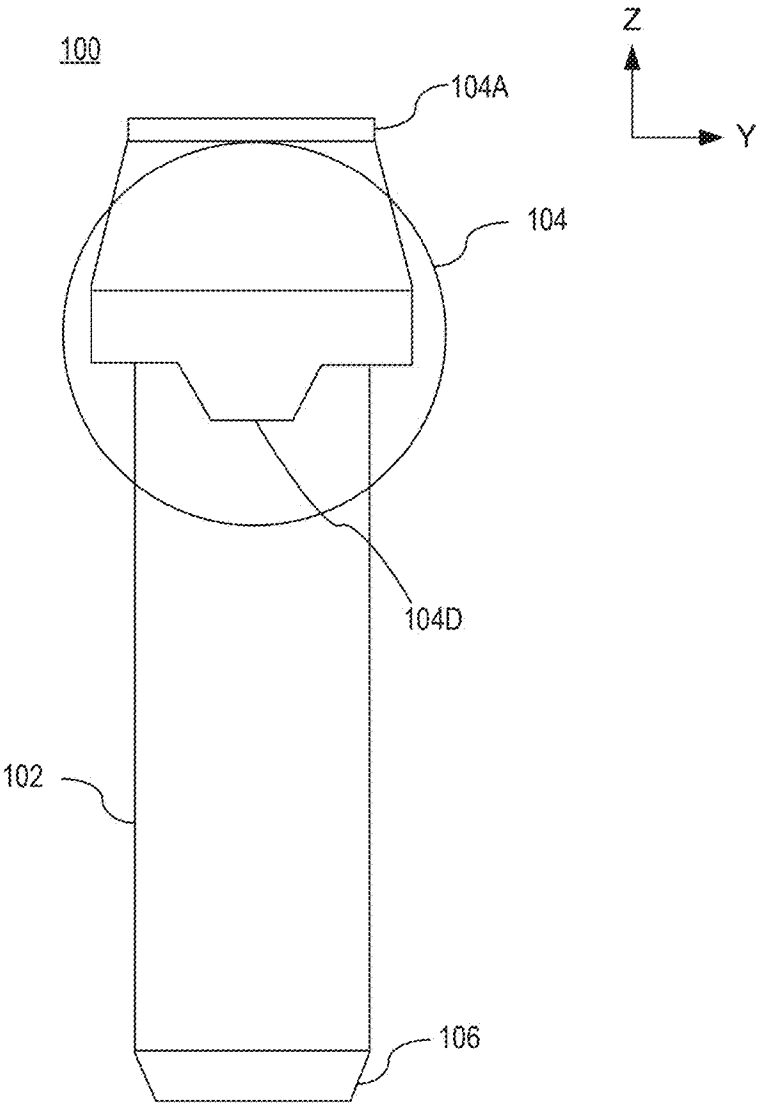
FIG. 1D illustrates a side view of the exemplary golf club adapter depicted in FIG. 1A, consistent with disclosed embodiments.

In some embodiments, head 104 may be configured to physically slot and/or securely connect with the hosel of a golf club head. For example, and as shown in FIGS. 1A, 1D, and 1E, head 104 may comprise a top portion 104A, a middle portion 104B, and a bottom portion 104C.

In some embodiments, head 104 may include one or more teeth 104D. For example, teeth 104D may extend downward and overlap or extend over a portion of body insert 102. In some embodiments, teeth 104D may be machined or designed to function as an anti-rotation feature when a club head and golf club adapter 100 are drawn securely together. For example, teeth 104D may be configured to engage an outer surface of a hosel of a golf club head. The outer surface of the hosel of the golf club head may include one or more complementary recesses configured to receive one or more teeth 104D. When body insert 102 is fully inserted into the hosel of the golf club head, teeth 104D may engage with the corresponding recess of the hosel, and thereby substantially prevent rotation of the golf club head relative to golf club adapter 100 and a golf club shaft connected thereto. In some embodiments, as shown in, for example, FIGS. 1A and 1D, golf club adapter 100 may include two or more teeth 104D.

In some embodiments, the engagement aperture 107 may be configured to receive a fastener such that, when the fastener is fully inserted into engagement aperture 107, the fastener is substantially flush with base 106. For example, base 106 may be tapered and include an outer diameter equal to a diameter of body insert 102 and an inner diameter smaller than the outer diameter. The inner diameter may equal a diameter of a head of a fastener. For example, once the fastener is fully inserted into engagement aperture 107, the head of the fastener may be substantially flush with base 106 (i.e., lie in the same plane), forming a substantially flush interface with base 106.

In some embodiments, shaft bore 105 may be dimensioned based on a type of golf club shaft. For example, shaft bore 105 may have differing dimensions (e.g., inner diameter and length) to accommodate a tapered-tip shaft. In other embodiments, shaft bore 105 may include continuous dimensions (e.g., continuous inner diameter and continuous length) to accommodate a parallel-tip shaft. Additionally, or alternatively, in some embodiments, shaft bore 105 may include a tapered arrangement that may be machined or designed to predetermined dimension(s) configured to be compatible with a plurality of types of shafts. For example, the tapered arrangement may have a single length designed to engage any or all types of shafts.

In some embodiments, golf club adapter 100 may comprise a single component. For example, head 104 may be integrally formed with body insert 102 by, for example, machining, casting, or molding golf club adapter 100 from one solid piece of material.

In some embodiments, body insert 102 and head 104 may be formed as two separate pieces. In such embodiments, body insert 102 and head 104 may be coupled via an adhesive, epoxy, or welding. Additionally, or alternatively, body insert 102 and head 104 may be coupled via a mechanical means. For example, body insert 102 and head 104 may be coupled via a friction fit or by threading head 104 onto body insert 102.

In some embodiments, any or all of the components of golf club adapter 100 may be machined or designed to have a suitable length, diameter, depth, or any other physical characteristic or dimension. For example, body insert 102 may be machined or designed to have a suitable length and diameter to fit a particular hosel type or size. The suitable dimensions may be based at least in part on dimensions of a standard golf club head. By way of a non-limiting example, body insert 102 may include a suitable diameter (e.g., approximately 0.435 inches) to securely fit within the hosel of the golf club head.

In some embodiments, golf club adapter 100 may include a suitable length. By way of a non-limiting example, golf club adapter 100 may include a total length of approximately 1.790 inches. Further, body insert 102 may include a total length of approximately 1.360 inches, and head 104 may include a total length of approximately 0.530 inches. Additionally, base 106 may include a length of approximately 0.090 inches.

In some embodiments, teeth 104D may include a suitable length. By way of a non-limiting example, teeth 104D may include a length of approximately 0.100 inches. In some embodiments, a length, a size, and/or spacings of teeth 104D may affect golf club performance. By way of a non-limiting example, teeth 104D having a shorter length (e.g., less than 0.100 inches), may be more suitable for users with and/or may facilitate a slower club head speed at impact and/or less torque input into the club head during off-center impacts.

In some embodiments, shaft bore 105 may be machined or designed to have one or more suitable diameters and depth. For example, shaft bore 105 may include a suitable diameter based at least in part on the dimensions of a standard golf club shaft. By way of a non-limiting example, shaft bore 105 may include a diameter of approximately 0.375 inches to accept the tip end of a standard, parallel-tip golf shaft. It should also be appreciated that shaft bore 105 may be machined or designed to have a suitable length or diameter based on other types of club shafts, such as, for example, taper-tip shifts, iron shafts, wood shafts, and hybrid shafts. In some embodiments, bottom portion 105A may include a chamfer. By way of a non-limiting example, bottom portion 105A may include a chamfer with a radius of 0.020 inches.

By way of a non-limiting example, head 104 may include an outer diameter of approximately 0.595 inches. In some embodiments, head 104 may be machined or designed to have an outer diameter substantially matching the outer diameter of a hosel of a golf club head.

In some embodiments, engagement aperture 107 may be machined or designed to have one or more suitable diameters or slopes. By way of a non-limiting example, engagement aperture 107 may include a first inner diameter of approximately 0.205 inches and a second inner diameter of approximately 0.361 inches. Further, engagement aperture 107 may also include a suitable slope (e.g., 82 degrees) between the first and second inner diameters. In some embodiments, the dimensions of engagement aperture 107 may be based at least in part on a fastener. By way of a non-limiting example, engagement aperture 107 may be designed to receive an M5×0.8 helicoil tap.

In some embodiments, head 104 may be machined or designed to have suitable dimensions. By way of a non-limiting example, top portion 104A may include a diameter of approximately 0.455 inches and a height of approximately 0.020 inches. Further, middle portion 104B may include a conical frustum with a height of approximately 0.260 inches. Moreover, Bottom portion 104C may include a diameter of approximately 0.595 inches and a total height of approximately 0.250 inches.

In some embodiments, one or more teeth 104D may be machined or designed to have suitable shapes and dimensions. For example, one or more teeth 104D may include a trapezoidal shape with a height of approximately 0.100 inches. One or more teeth 104D may also include a terminal end having a width of approximately 0.150 inches) and sidewalls extending from the bottom portion 104C at an angle of approximately 120 degrees. It should be appreciated that teeth 104D may include any other quantity, dimensions, and shapes.

In some embodiments, the hosel of the golf club head may be manipulated to accommodate body insert 102 of golf club adapter 100. For example, the inner diameter of the hosel may be increased by any suitable methods, such as, for example, boring techniques, to receive body insert 102 of golf club adapter 100.

Figure 2A:
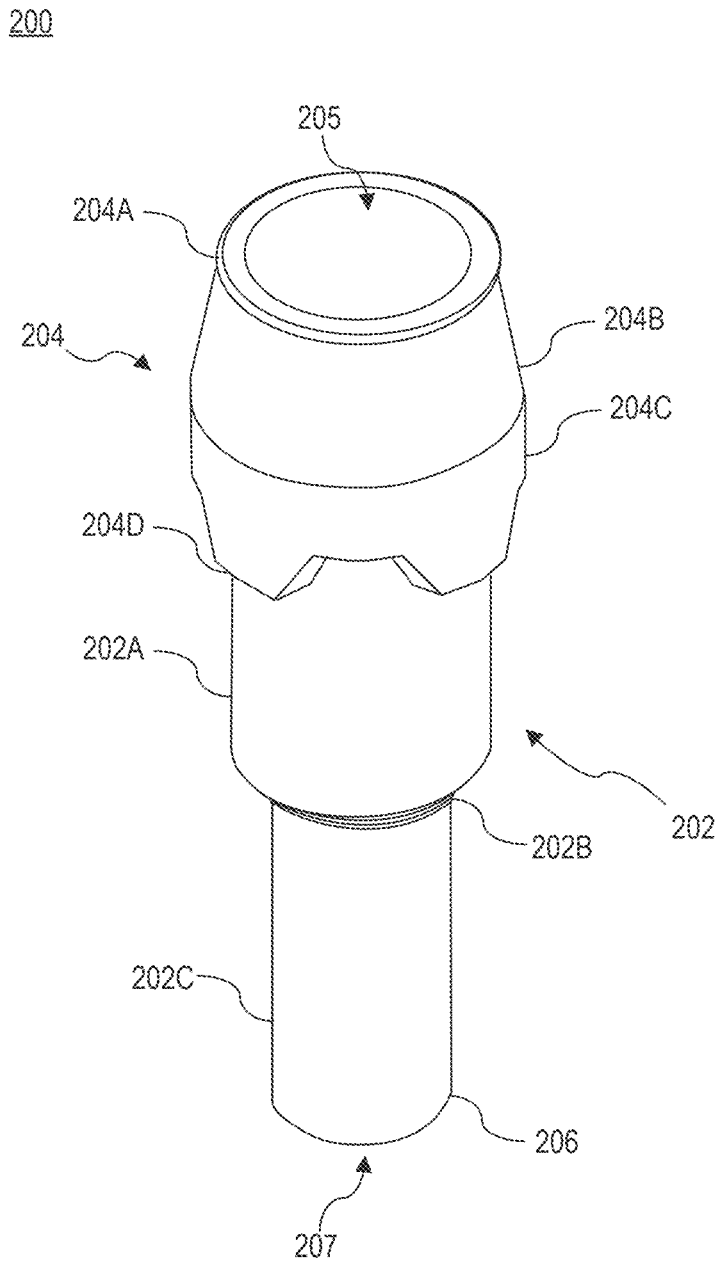
FIG. 2A illustrates a perspective view of an exemplary golf club adapter, consistent with disclosed embodiments.
Figure 2C:
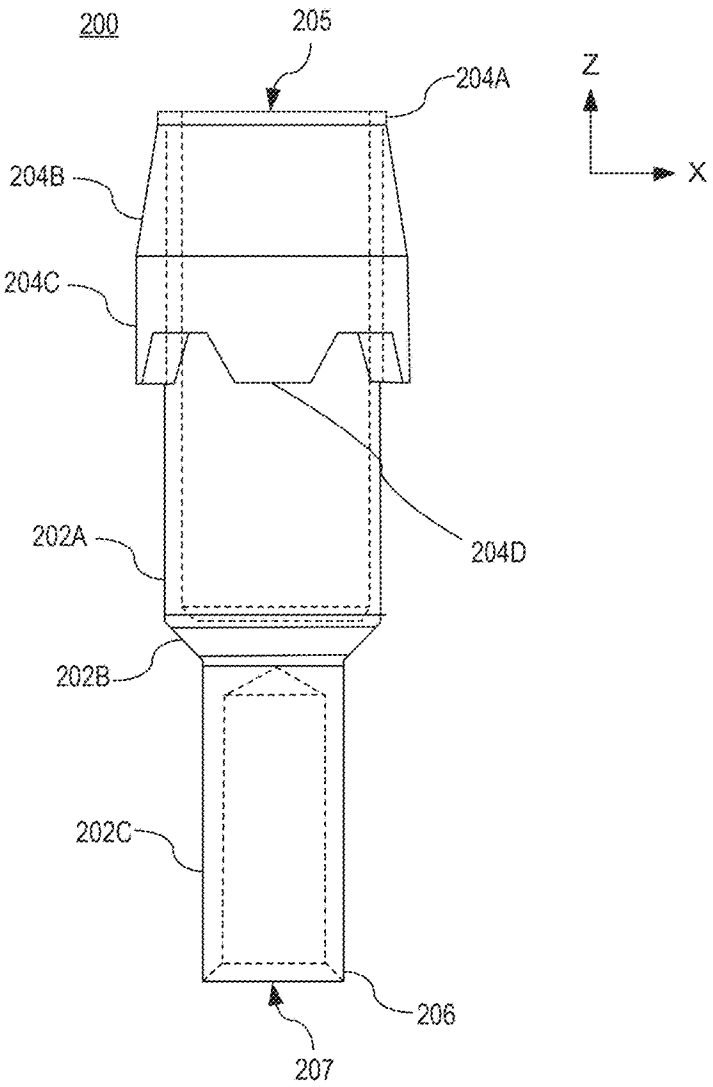
FIG. 2C illustrates a side view of the exemplary golf club adapter depicted in FIG. 2A with certain parts shown in transparency, consistent with disclosed embodiments.
Figure 2B:
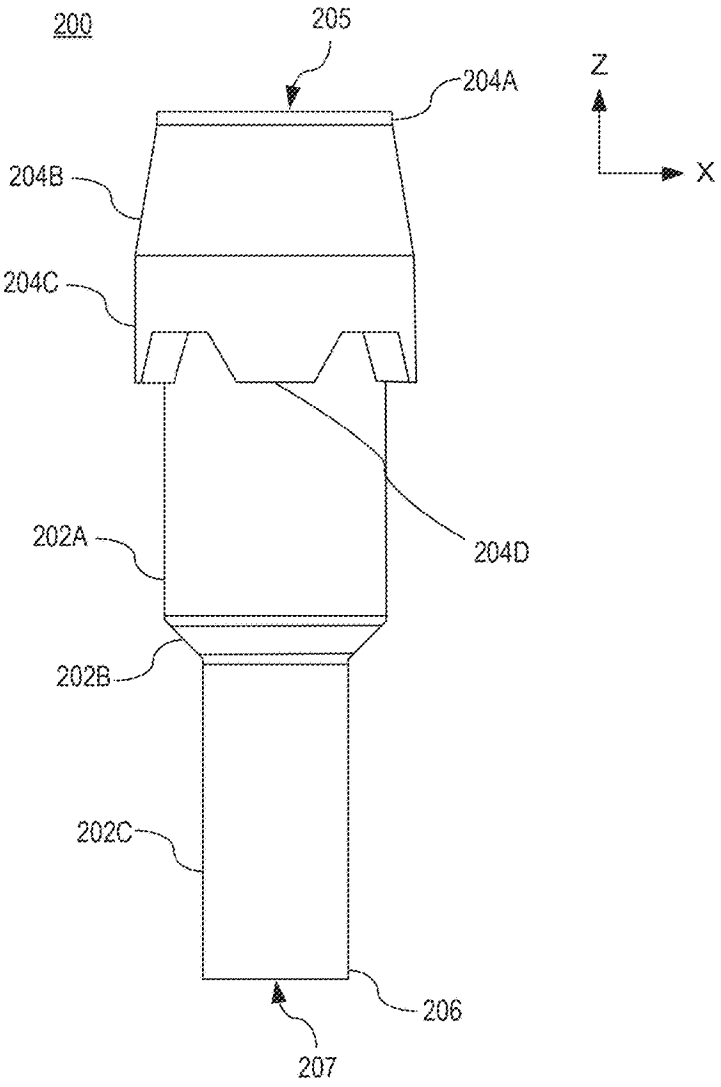
FIG. 2B illustrates a side view of the exemplary golf club adapter depicted in FIG. 2A, consistent with disclosed embodiments.
Figure 2D:
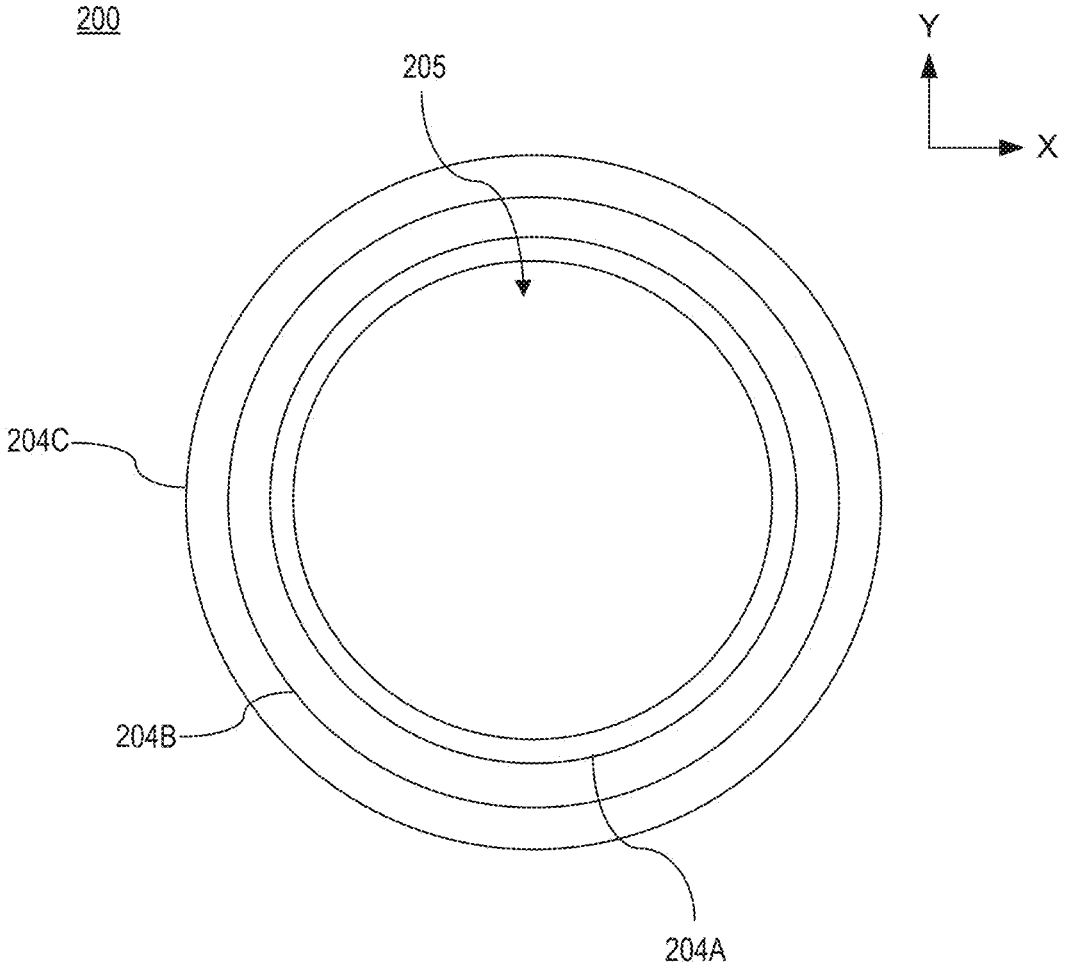
FIG. 2D illustrates a top view of the exemplary golf club adapter depicted in FIG. 2A, consistent with disclosed embodiments.

FIGS. 2A-2D illustrates various views of an exemplary golf club adapter 200, consistent with disclosed embodiments. Golf club adapter 200 may be understood to be similar to golf club adapter 100 except as explicitly described below. In some embodiments, golf club adapter 200 may include a body insert 202, a head 204, and a base 206. In FIG. 2C, body insert 202, head 204, and base 206 are depicted as transparent to show that body insert 202 may include a shaft bore 205 and an engagement aperture 207. Shaft bore 205 may extend from a top end of golf club adapter 200 and partially through body insert 202. Engagement aperture 207 may extend from base 206 and partially through body insert 202. Although body insert 202, head 204, and base 206 are labeled and described as separate components, it should be understood that any combination of body insert 202, head 204, and base 206 may be a single piece or component.

In some embodiments, body insert 202 may comprise a top segment 202A, a middle segment 202B, and a bottom segment 202C. For example, top segment 202A may have a first outer diameter, bottom segment 202C may have a second outer diameter less than the first outer diameter of top segment 202A, and middle segment 202B may have a sloped surface transitioning from the first outer diameter to the second outer diameter. In some embodiments, golf club adapter 200 may include a chamfer between top segment 202A and middle segment 202B. In some embodiments, golf club adapter 200 may include a chamfer between bottom segment 202C and middle segment 202B. The intermediate chamfers may increase the structural strength or stability of golf club adapter 200.

In some embodiments, head 204 may include four teeth 204D. In some embodiments, head 204 may be machined or designed to contain any suitable number of teeth 204D. For example, the shape, number, spacing, and/or dimensions of teeth 104D, 204D of head 104, 204 may be machined or designed to mate with corresponding teeth on the hosel of a golf club head.

In some embodiments, any or all of the components of golf club adapter 200 may be machined or designed to have a suitable length, diameter, depth, or any other physical characteristic or dimension. For example, a suitable length and diameter of any or all of the segments of body insert 202 may correspond to a standard golf club head and/or a custom configuration for a particular user. By way of a non-limiting example, body insert 202 may include a total length of 1.170 inches and may have a varying diameter. For example, top segment 202A may include a length of 0.460 inches and a diameter of 0.430 inches. Further, middle segment 202B may include a length of 0.056 inches and may include a conical, sloped diameter between the diameter of top segment 201A and bottom segment 201C. Moreover, bottom segment 202C may include a length of 0.620 inches and a diameter of 0.2898 inches. One or both intermediate chamfers between neighboring segments of body insert 202 may include a length of 0.025 inches. It should be appreciated that shaft bore 205 and/or engagement aperture 207 may be oriented at any suitable angle(s) relative to body insert 202 to accommodate desired performance specifications of the golf club, such as, for example, various loft angles and/or lie angles, in a similar manner as discussed above with respect to shaft bore 105, 505 and engagement aperture 107, 507. It should also be appreciated that shaft bore 205 and/or engagement aperture 207 may facilitate adjustability of the angle(s) of engagement between the golf club head and the golf club shaft in a similar manner as discussed above with respect to shaft bore 105 and engagement aperture 107.

In some embodiments, the segments of body insert 202 may be machined or designed to correspond to a sleeve. For example, the dimensions of the segments of body insert 202 may correspond to a weight sleeve, such as weight sleeve 300, as described and exemplified further below.

Figure 3A:
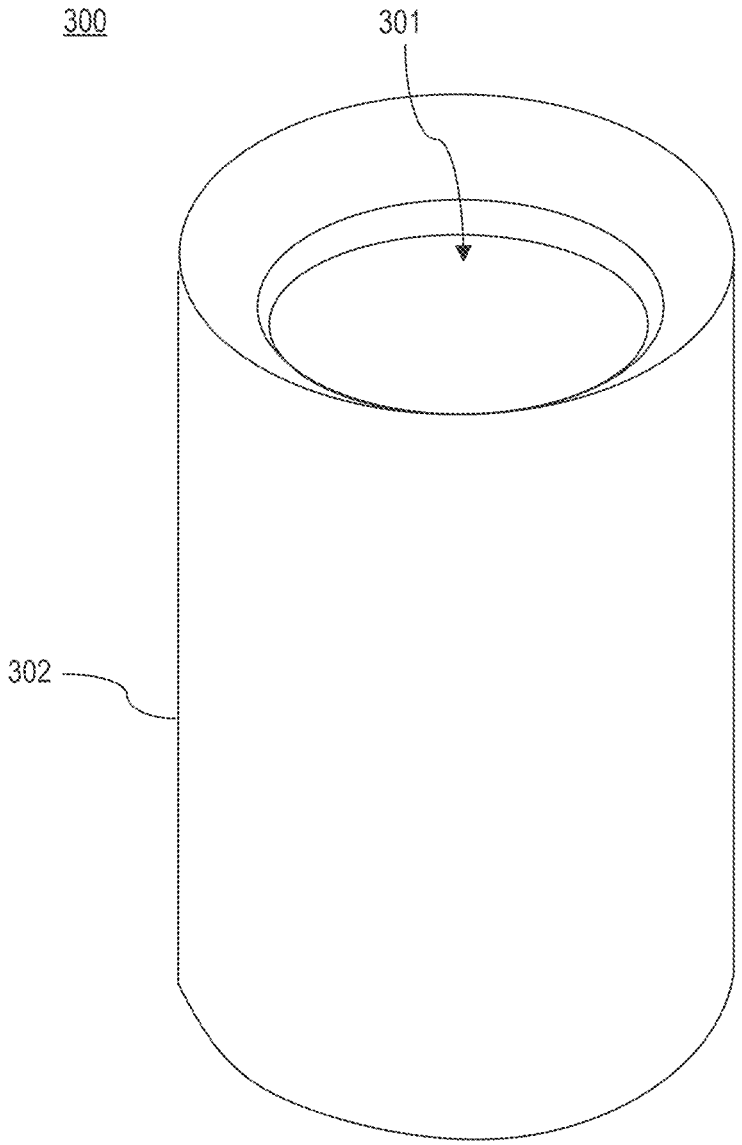
FIG. 3A illustrates a perspective view of an exemplary weight sleeve, consistent with disclosed embodiments.
Figure 3C:
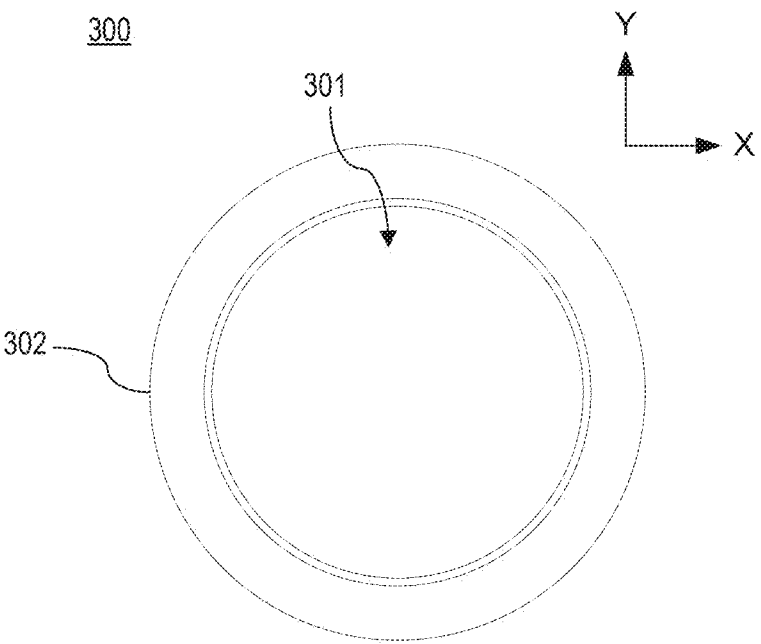
FIG. 3C illustrates a top view of the exemplary weight sleeve depicted in FIG. 3A, consistent with disclosed embodiments.
Figure 3B:
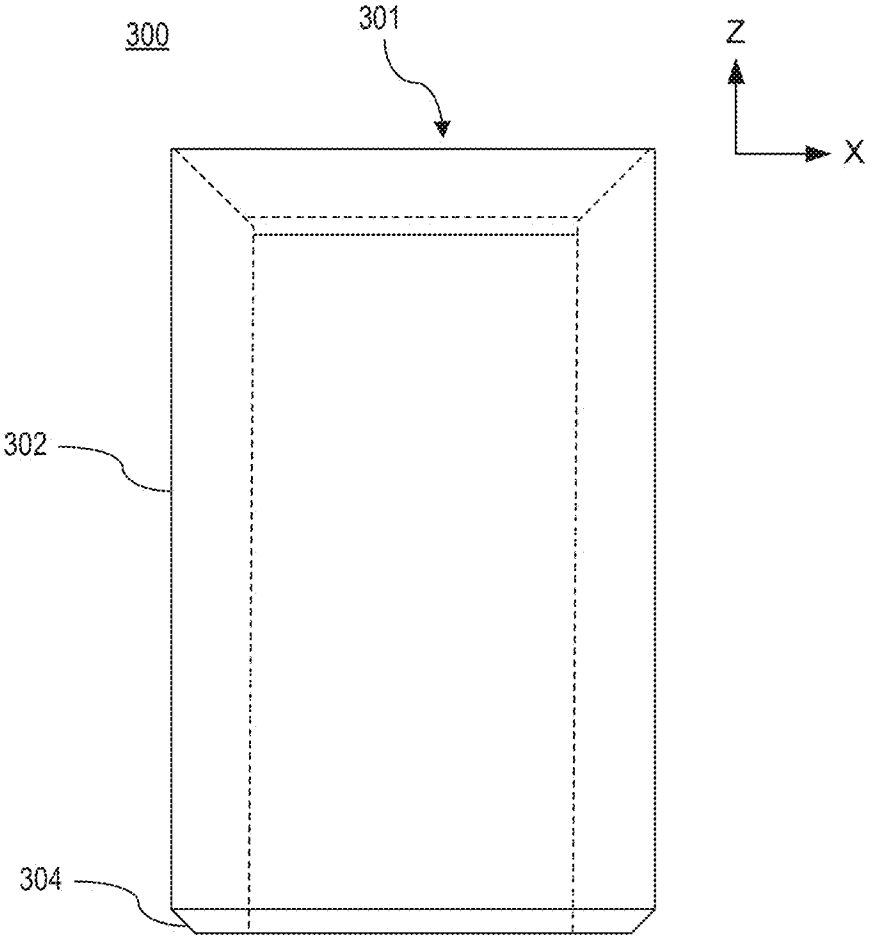
FIG. 3B illustrates a side view of the exemplary weight sleeve depicted in FIG. 3A, consistent with disclosed embodiments.

FIGS. 3A-3D illustrates various views of an exemplary weight sleeve 300, consistent with disclosed embodiments. In some embodiments, weight sleeve 300 may include a body 302 and a base 304. In FIG. 3B, body 302 and base 304 are depicted as transparent to show that body 302 may include a bore 301.

In some embodiments, weight sleeve 300 and body insert 202 may be formed as two separate pieces. In some embodiments, weight sleeve 300 may be machined or designed to fit through or around part or all a golf club adapter (e.g., golf club adapter 100, 200, 500). In some embodiments, the weight sleeve 300 may be directly attached or fixed to a golf club adapter. For example, bottom segment 202C of golf club adapter 200 may be inserted through bore 301. Weight sleeve 300 may be coupled to golf club adapter 200 via one or more fastening elements. For example, weight sleeve 300 may be coupled to golf club adapter 200 by a glue, epoxy, a screw, or a magnet.

Additionally, or alternatively, in some embodiments weight sleeve 300 may be detachably connected to a golf club adapter. For example, bottom segment 202C may be inserted through bore 301 of weight sleeve 300, and weight sleeve 300 may include threads configured to engage and disengage corresponding threads positioned on middle segment 202B. Bore 301 of weight sleeve 300 may include a tapered configuration corresponding to the outer diameters of middle segment 202B and bottom segment 202C of body insert 202. Once the weight sleeve 300 is engaged with the golf club adapter 200, the weight sleeve 300 may include a substantially flush interface (e.g., smooth or level) with top segment 201A. For example, the outer diameters of weight sleeve 300 and top segment 202A may be substantially the same. In other embodiments, weight sleeve 300 may include an outer diameter that is less than the outer diameter of top segment 202A to provide a tapered configuration.

In some embodiments, weight sleeve 300 and body insert 202 may comprise a single component. For example, weight sleeve 300 may be integrally formed with body insert 202 by, for example, machining, casting, or molding golf club adapter 100 and weight sleeve 300 from one solid piece of material. It should also be appreciated that weight sleeve 300 may be releasably secured to body insert 202 via any other suitable means, such as, for example, pins, cams, friction fit, or removable fasteners.

In some embodiments, weight sleeve 300 may comprise a suitable material, weight, and/or density to readily adjust the performance of the golf club. By way of a non-limiting example, weight sleeve 300 may comprise tungsten of any suitable weight (e.g., 10 grams) to change the swing weight (e.g., increase) of the golf club. Other weights and materials for weight sleeve 300 may be selected to facilitate a desired swing weight for the golf club. By including a weight sleeve with the golf club adapter, the swing weight of the golf club may be easily customizable, allowing for a more synergistic fit of a more diverse array of golf club shafts and heads and accommodate desired performance specifications of the golf club.

Figure 4:
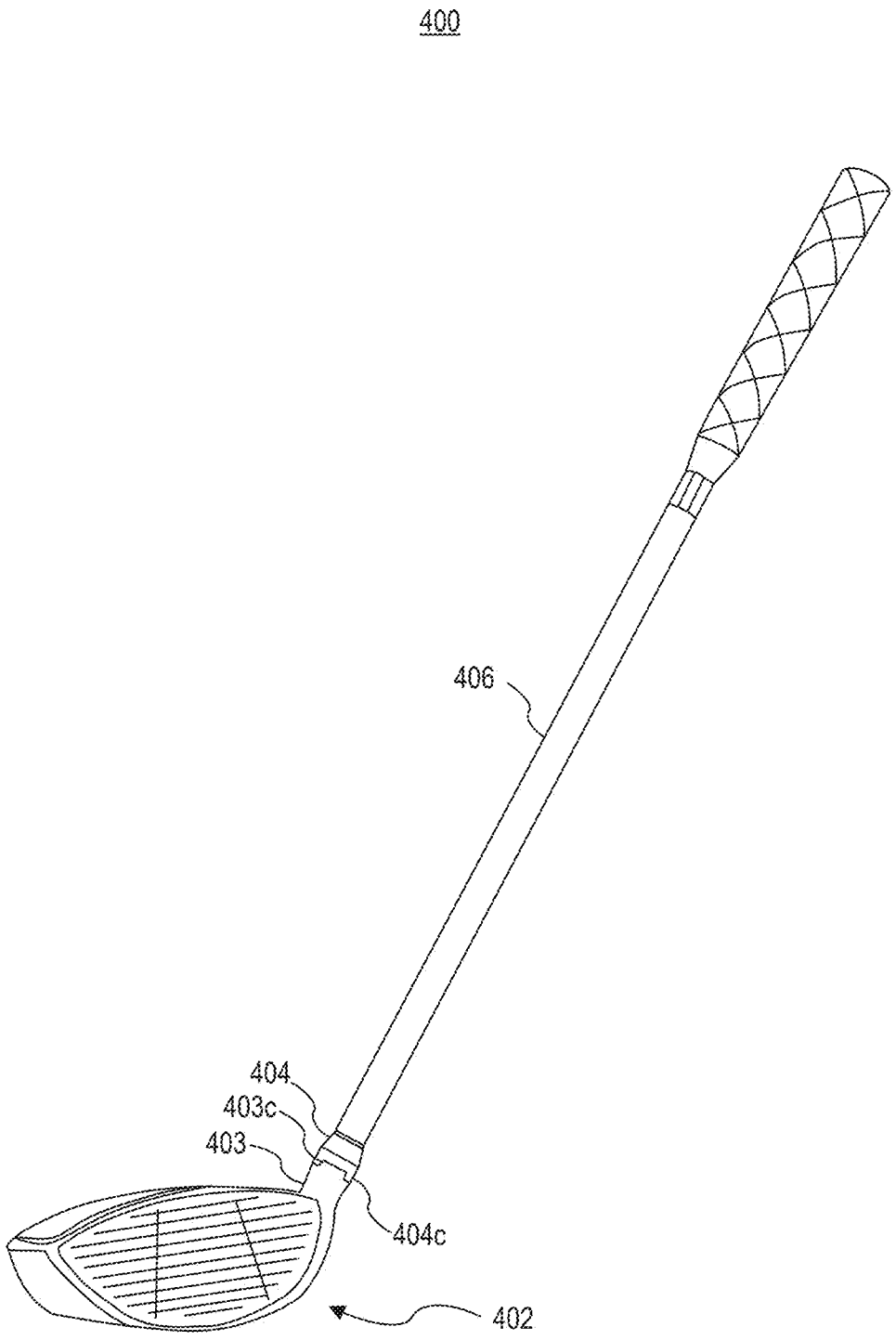
FIG. 4 illustrates a perspective view of an exemplary golf club, consistent with disclosed embodiments.

FIG. 4 illustrates a perspective view of an exemplary golf club 400, consistent with disclosed embodiments. In some embodiments, golf club 400 may include a golf club head 402, a golf club adapter 404, and a golf club shaft 406. It may be understood that golf club adapter 404 may be similar to golf club adapter 100, 200, 500, including golf club adapter 200 with weight sleeve 300.

As discussed above, in some embodiments, a tip of golf club shaft 406 may be configured to be fixedly secured within a shaft bore of golf club adapter 404. For example, the tip of golf club shaft 406 may be secured within the shaft bore of golf club adapter 404 via a friction fit arrangement. Additionally, or alternatively, an adhesive or epoxy may be applied to an inner surface of the shaft bore of golf club adapter 404 and/or to an outer surface of the tip end of golf club shaft 406 to securely bond golf club shaft 406 to the shaft bore of golf club adapter 404.

In some embodiments, golf club head 402 may include a hosel 403. Hosel 403 may refer to the part of golf club head 402 to which golf club adapter 404 may be releasably connected.

As discussed above, in some embodiments, golf club adapter 404 may include a body insert configured to be inserted into hosel 403 of golf club head 402. For example, a body insert of golf club adapter 404 may be inserted into hosel 403 of golf club head 402. A fastener may be inserted through a hole at the bottom or sole portion of golf club head 402 and engaged into an engagement aperture of golf club adapter 404. For example, the fastener may be a screw, which may be screwed (e.g., using a wrench) through the hole of golf club head 402 into the engagement aperture of golf club adapter 404. Additionally, the fastener may be disengaged (e.g., using a wrench) to disconnect golf club head 402 from golf club adapter 404 and golf club shaft 406. In this way, golf club head 402 and golf club shaft 406 may be releasably connected via golf club adapter 404. Further, because the fastener is inserted from the bottom or sole portion of golf club head 402, golf club 400 may appear like a standard club with no visible nuts or protrusions.

As discussed above, in some embodiments, golf club adapter 404 may include a head portion configured to engage an outer surface of hosel 403. For example, golf club adapter 404 may include one or more teeth 404*c* configured to engage and interlock with one or more corresponding teeth 403*c* and complementary recesses of hosel 403. In this way, golf club head 402 may be substantially prevented from rotating relative to golf club adapter 404 and golf club shaft 406.

Although the above exemplary description describes affixing golf club shaft 406 to golf club adapter 404 and then securing golf club head 402 to golf club adapter 404, it may be understood that the golf club head 402, golf club adapter 404, and golf club shaft 406 may be joined together in any suitable order to form golf club 400.

Certain features which, for clarity, are described in this specification in the context of separate embodiments may also be provided in combination in a single embodiment. Conversely, various features which, for brevity, are described in the context of a single embodiment may also be provided in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

While the present disclosure has been shown and described with reference to particular embodiments thereof, it will be understood that the present disclosure can be practiced, without modification, in other environments. The foregoing description has been presented for purposes of illustration. It is not exhaustive and is not limited to the precise forms or embodiments disclosed. Modifications and adaptations will be apparent to those skilled in the art from consideration of the specification and practice of the disclosed embodiments.

Moreover, while illustrative embodiments have been described herein, the scope of any and all embodiments having equivalent elements, modifications, omissions, combinations (e.g., of aspects across various embodiments), adaptations and/or alterations as would be appreciated by those skilled in the art based on the present disclosure. The limitations in the claims are to be interpreted broadly based on the language employed in the claims and not limited to examples described in the present specification or during the prosecution of the application. The examples are to be construed as non-exclusive. Furthermore, the steps of the disclosed methods or processes may be modified in any manner, including by reordering steps and/or inserting or deleting steps. It is intended, therefore, that the specification and examples be considered as illustrative only, with a true scope and spirit being indicated by the following claims and their full scope of equivalents.

What is claimed is:

1. A golf club adapter, comprising:

a cylindrical body insert configured to be inserted into a hosel of a golf club head, the cylindrical body insert including:

a longitudinal axis;

a shaft bore configured to receive a golf club shaft, wherein the shaft bore is angled relative to the longitudinal axis of the cylindrical body insert; and an engagement bore configured to receive a fastener;

a head portion configured to engage an outer surface of the hosel of the golf club head and substantially prevent rotation between the golf club shaft and the golf club head; and a round, tapered base having a first diameter equal to a diameter of the cylindrical body insert and a second diameter smaller than the first diameter.

2. The golf club adapter of claim 1, wherein the cylindrical body insert, the tapered base, and the head portion are formed as a single piece.

3. The golf club adapter of claim 1, wherein the shaft bore includes a non-parallel arrangement relative to the longitudinal axis of the cylindrical body insert.

4. The golf club adapter of claim 1, wherein the shaft bore is angled relative to a transverse axis of the cylindrical body insert.

5. The golf club adapter of claim 4, wherein the shaft bore includes a non-perpendicular arrangement relative to the transverse axis of the cylindrical body insert.

6. The golf club adapter of claim 1, wherein:

the head portion comprises one or more teeth, and wherein the one or more teeth of the head portion are configured to engage complementary recesses on the outer surface of the hosel of the golf club head.

7. The golf club adapter of claim 1, wherein a tip of the golf club shaft is configured to be fixedly secured within the shaft bore.

8. The golf club adapter of claim 1, wherein the golf club adapter is configured to be releasably secured to the golf club head by engaging and disengaging the fastener to the engagement bore.

9. A golf club adapter, comprising:

a body insert configured to be inserted into a hosel of a golf club head, the body insert including:

a cylindrical top segment having a first outer diameter;

a cylindrical bottom segment having a second outer diameter less than the first outer diameter;

a middle segment positioned between the cylindrical top segment and the cylindrical bottom segment;

a shaft bore configured to receive a golf club shaft, wherein the shaft bore extends at least partially through the cylindrical top segment; and an engagement bore configured to receive a fastener, wherein the engagement bore extends at least partially through the cylindrical bottom segment and up to the middle segment;

a weight sleeve configured to releasably engage with the body insert; and a head portion configured to engage an outer surface of the hosel of the golf club head and substantially prevent rotation between the golf club shaft and the golf club head.

10. The golf club adapter of claim 9, wherein the middle segment of the body insert includes a sloped surface.

11. The golf club adapter of claim 10, wherein the weight sleeve engages the sloped surface of the middle segment and is configured to form a substantially flush interface with the cylindrical top segment.

12. The golf club adapter of claim 9, wherein the weight sleeve includes a bore configured to receive the cylindrical bottom segment of the body insert.

13. The golf club adapter of claim 9, wherein the weight sleeve is configured to releasably engage with the body insert via a threaded arrangement.

14. The golf club adapter of claim 13, wherein the weight sleeve includes threads configured to releasably engage with corresponding threads positioned on the middle segment of the body insert.

15. The golf club adapter of claim 9, wherein the shaft bore is angled relative to a longitudinal axis of the body insert.

16. The golf club adapter of claim 15, wherein the shaft bore includes a non-parallel arrangement relative to the longitudinal axis of the body insert.

17. A golf club, comprising:

a golf club head including a hosel;

a golf club shaft; and a golf club adapter configured to releasably connect the golf club shaft to the golf club head, the golf club adapter including:

a body insert configured to be inserted into the hosel of the golf club head, the body insert including:

a cylindrical top segment having a first outer diameter;

a cylindrical bottom segment having a second outer diameter less than the first outer diameter;

a middle segment positioned between the cylindrical top segment and the cylindrical bottom segment;

a shaft bore configured to receive the golf club shaft, wherein the shaft bore extends at least partially through the cylindrical top segment; and an engagement bore configured to receive a fastener, wherein the engagement bore extends at least partially through the cylindrical bottom segment and up to the middle segment;

a weight sleeve configured to releasably engage with the body insert; and a head portion configured to engage an outer surface of the hosel of the golf club head and substantially prevent rotation between the golf club shaft and the golf club head.

18. The golf club of claim 17, wherein a tip of the golf club shaft is configured to be fixedly secured within the shaft bore.

19. The golf club of claim 17, wherein the golf club adapter is configured to be releasably secured to the golf club head by engaging and disengaging the fastener to the engagement bore.

20. The golf club of claim 17, wherein:

the head portion comprises one or more teeth, and the one or more teeth of the head portion are configured to engage complementary recesses on the outer surface of the hosel of the golf club head.

* * * * *